US005193928A

United States Patent [19]

Balzer et al.

[11] Patent Number: 5,193,928

[45] Date of Patent: Mar. 16, 1993

[54] FLUID APPLICATION DEVICE WITH SLIDING SLEEVE CUTTING MEMBER

[75] Inventors: Dieter Balzer, Wilen; Fabian Gysin; Robert Schoenholzer, both of Wädenswil, all of Switzerland

[73] Assignee: Essex Specialty Products, Inc., Clifton, N.J.

[21] Appl. No.: 901,928

[22] Filed: Jun. 22, 1992

[30] Foreign Application Priority Data

Jun. 22, 1991 [DE] Fed. Rep. of Germany ..... 4120634

[51] Int. Cl.[5] ..... B05C 17/00

[52] U.S. Cl. ..... 401/132; 401/134; 401/117; 401/193; 401/207; 222/83; 604/3

[58] Field of Search ..... 401/132, 133, 134, 135, 401/117, 193, 207; 604/3; 222/83

[56] References Cited

FOREIGN PATENT DOCUMENTS 929331 6/1963 United Kingdom ..... 401/134

*Primary Examiner*—Steven A. Bratlie

*Attorney, Agent, or Firm*—Tarolli, Sundheim & Covell

[57] ABSTRACT

The invention provides a device for applying a fluid medium onto the surface of an article. It comprises a tightly sealed, preferably metallic storage container and a fluid application assembly including a sleeve member and an application member which latter is laterally covered by the sleeve member when the device is in its inoperative position. Upon executing a relative movement between sleeve member and storage container, a locking member is destroyed, a seal of the container is broken and the application member is exposed such that the device is ready to use. It is particularly suitable for storing and applying small amounts of moisture-sensitive liquids, e.g. primers for adhesive joints.

11 Claims, 3 Drawing Sheets

FLUID APPLICATION DEVICE WITH SLIDING SLEEVE CUTTING MEMBER

BACKGROUND OF THE INVENTION

The present invention refers to a device for applying a fluid medium onto the surface of an article, particularly for applying a moisture-sensitive primer for adhesive joints, comprising a moisture- and air-tight container for receiving the fluid medium, said container having a central longitudinal axis and being provided with a fluid application assembly.

It is well known in the art that fluid media based on organic compounds, e.g. primer liquids for adhesive joints, change their chemical structure under the influence of atmospheric moisture, i.e. particularly they cure. Thus, such liquids must be stored in air- and moisture-tight containers. As a rule, only metallic containers are suitable for this purpose, unlike containers made of plastic material which are not in a position to meet all these requirements, particularly if the container must be stored during a long period of time.

To be used, i.e. to be applied to an article, these liquids are filled from the more or less large metallic storage containers in a small application container whose outlet opening is provided with a fluid application assembly, e.g. in the shape of a felt stopper. If the content of this application container is immediately and completely used, the application container may be made of plastic material without disadvantages.

In certain kinds of applications, particularly if only a small amount of the liquid is to be used, it has been shown that the previously mentioned bottling, i.e. the filling of small plastic containers from large metallic storage containers, is impractical, complicated and time-consuming.

A solution well known in the art is constituted by the so-called applicator pens in which the liquid is fed in predetermined amounts from a stock chamber to an application assembly by means of a dosing element. In this applicator pen, the application of the liquid onto an article is accomplished by means of a dosing piston with pumping movements with the result that it is not possible to get an even layer of the liquid on the surface of the article because the application of the liquid is discontinuous. Furthermore, the handling of such a device is complicated and awkward. Finally, such an applicator pen is not suitable to be designed as a disposable which is used only once but should be stored for a long period of time.

OBJECTS OF THE INVENTION

It is an object of the invention to provide a device for applying a fluid medium onto the surface of an article, particularly for applying a moisture-sensitive primer for adhesive joints, which does not have the disadvantages of the known applicator pens.

It is a further object of the invention to provide a device for applying a fluid medium onto the surface of an article, particularly for applying a moisture-sensitive primer for adhesive joints, which can be stored for a long period of time and which can be put into an operative condition with a very short and simple handling operation.

It is a still further object of the invention to provide a device for applying a fluid medium onto the surface of an article, particularly for applying a moisture-sensitive primer for adhesive joints, which comprises a hermetically sealed container which can be opened with one simple motion whereby simultaneously the fluid application assembly is put in a condition ready for use.

It is a still further object of the invention to provide a device for applying a fluid medium onto the surface of an article, particularly for applying a moisture-sensitive primer for adhesive joints, which is simple in design and inexpensive to manufacture and thus can be disposed after use.

SUMMARY OF THE INVENTION

To achieve these and other objects of the invention, there is provided a device for applying a fluid medium onto the surface of an article, particularly for applying a moisture-sensitive primer for adhesive joints. The device comprises a moisture- and air-tight container for receiving the fluid medium. The container has a central longitudinal axis and is provided with an application assembly. Further, the container comprises an outlet opening and a sealing diaphragm sealing the outlet opening of the container in an air- and moisture-tight manner.

The application assembly is fixed to the container at the outlet opening thereof and comprises a fluid application member which is immovable with regard to the container and which is laterally covered by a sleeve member. The sleeve member is displaceable in the direction of the central longitudinal axis of the container whereby a locking member is provided to prevent an unintentional axial displacement of the sleeve member.

The sleeve member further comprises a cutting member displaceable together with the sleeve member and adapted to destroy the sealing diaphragm. Thereby, the fluid application member is exposed out of the interior of the sleeve member and the sealing diaphragm is destroyed upon removing or destroying the locking member and displacing the sleeve member along the central longitudinal axis towards the container.

Consequently, the fluid application device of the invention comprises a storage container which is suitable to store a liquid medium sensitive to atmospheric moisture during a long period of time. The storage container can be made of metal, e.g. aluminium, or of plastic material which is vapour plated with a metallic material, e.g. with aluminum. As the amounts of fluid medium to be applied onto an article are quite small, the storage container of the fluid application device can be designed correspondingly small and handy. The application assembly is operatively connected to the container in the region of its outlet opening such that the fluid application device is a compact integral unit. With the fluid application device of the invention, the content of the device can be applied onto an article without complicated preparations, particularly without bottling, with one simple stroke of manipulation.

A preferred embodiment of the fluid application device of the invention relates to the locking of the device against unintentional opening of the storage container. In this embodiment, the application assembly of the device comprises a cap screwed onto the container at the end thereof where the outlet opening is provided. The cap comprises a cylindrical hollow protrusion whereby the sleeve member is axially displaceably mounted on the protrusion. Further, a locking collar is provided on the protrusion serving as locking member and being located between the sleeve member and the cap.

In a preferred embodiment, the cutting member is fixed to the sleeve member by means of a flange member whereby the cutting member is constituted by a hollow cylindrical member having a sharp free edge at the side facing the container. It is arranged coaxially to the sleeve member and displaceable along the extension of the protrusion provided on the cap.

A practical design of the fluid application device can be such that the fluid application member is supported in the sleeve member by means of an annular washer comprising a lateral lug. The annular washer comprises a plurality of support members extending away from the fluid application member and resting with their free ends at the front wall of the cylindrical hollow protrusion of the cap.

Particularly, the locking collar can be constituted by an annular collar serving as a releasable stop member. The annular collar can be located such between the one end of the sleeve member facing the cap and a shoulder face of the cap that it is destroyed upon screwing or displacing the sleeve member towards the cap.

Finally, according to another embodiment, it is possible that the sleeve member is screwed directly onto the container and blocked, in its inoperative position, by means of a locking collar resting on a shoulder of the container constituted by a screw thread flight.

BRIEF DESCRIPTION OF THE DRAWINGS

In the following, some embodiments of the device according to the invention will be further described, with reference to the accompanying drawings, in which.

DETAILED DESCRIPTION OF SOME PREFERRED EMBODIMENTS

The device shown in FIGS. 1*a* to 1*d* is used, for example, for the application of a fluid primer used in connection with adhesive joints to the surface of an article. It comprises a cylindrical storage container 1 made, for example, of aluminum or a similar air- and moisture-tight material. The container 1 comprises a lid 2 sealing the back-sided open end of the container 1 through which, previously, the liquid content of the container 1 has been filled in. The lid 2 may be fixed to the container 2 e.g. by flanging or cupping in a manner well known in the art.

Figure 1A:
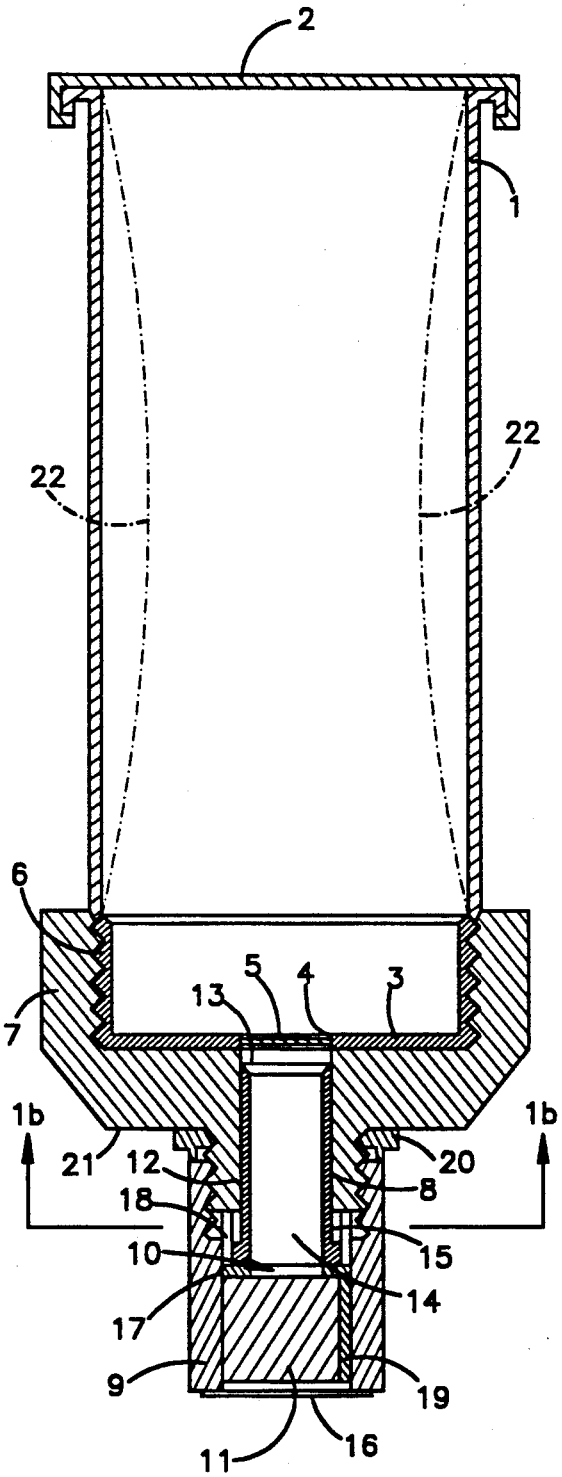
FIG. 1*a* shows a longitudinal sectional view of a first embodiment of the device according to the invention whereby the device is in its inoperative position (storage condition)
Figure 1C:
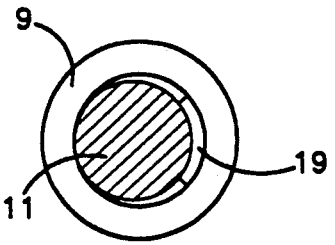
FIG. 1*c* shows a front view of the application assembly.
Figure 1D:
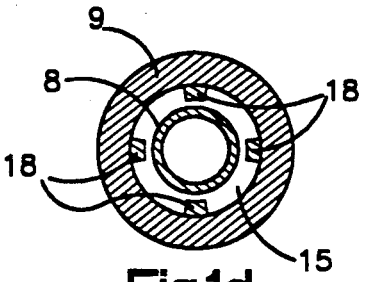
FIG. 1*d* shows a cross sectional view along the line A—A in FIG. 1.

The other end of the container 1 is the outlet end which is provided with a front container wall 3. In the centre of the front container wall 3 there is provided an outlet opening 4 which is sealed by a sealing diaphragm 5 as long as the device is in its inoperative position (storage condition) as shown in FIG. 1*a*. The sealing diaphragm 5 and the container wall 3 surrounding the outlet opening 4 consist of one piece whereby the diaphragm 5 is manufactured e.g. by material pressing. The cylindrical wall of the container 1 is provided, close to its outlet end, with an external or male screw thread 6, and the device comprises a cap 7 having a corresponding internal or female screw thread. The cap 7 is screwed onto the container 1 and is provided with a fluid application assembly.

The fluid application assembly comprises essentially a cutting member 8, a sleeve member 9 adapted to operate the cutting member 8 and an intermediate member 10 supporting a fluid application member 11. The fluid application member 11 is used to apply the content of the container 1 to the surface of an article and is made of an absorbent material, e.g. of felt; it has essentially the shape of a stopper or the like.

The cap 7 is provided with cylindrical hollow protrusion 12 having an external or male screw thread and the sleeve member is provided with a corresponding inner or female screw thread. Thus, the sleeve member 9 is movable in axial direction by rotating it around the cylindrical hollow protrusion 12. The cutting member 8 is constituted as a cylindrical hollow body arranged coaxially to the sleeve member 9 and axially movable in the cylindrical bore of the cylindrical hollow protrusion 12 of the cap 7. At the end of the cutting member 8 facing the container 1, it is provided with a sharp free edge 13 which serves to break open the sealing diaphragm 5.

The cylindrical hollow chamber 14 of the cutting member 8 connects the outlet opening 4 of the container 1 with the fluid application member 11 and thus forms a passage for the fluid content of the container 1. The sleeve member 9 is connected to the cutting member 8, which has a smaller diameter than the sleeve member 9, by means of a flange 15. Preferably, the cutting member 8, the sleeve member 9 and the flange 15 are made of one piece, e.g. of a suitable plastic material or of metal.

The fluid application member is covered laterally by the sleeve member 9 and frontally by a protection seal 16 fixed to the free front edge of the sleeve member 9. Prior to operating the device, the protection seal 16 is to be removed.

The intermediate member 10 comprises an annular washer 17 supporting the fluid application member 11 and is axially movably guided along the inner wall of the sleeve member 9. The annular washer 17 is provided with a plurality of support members 18 extending in a direction away from the fluid application member 11 and resting on the front surface of the cylindrical hollow protrusion 12. Furthermore, the intermediate member 10 comprises a lug 19 extending from the annular washer 17 and running along one lateral side of the fluid application member 11 from the annular washer 17 up to the operating end of the fluid application member 11. The lug 19 serves as a guiding member for guiding the fluid application device along the edge of an article onto which the fluid contained in the container 1 is to be applied.

In its inoperative position, i.e. in the storage condition of the device as shown in FIG. 1*a*, the cutting member 8 is prevented from being unintentionally operated by a releasable or destroyable locking member. The locking collar 20 serves as a stop member preventing an unintentional axial movement of the sleeve member 9 and, thereby, of the cutting member 8 operatively connected to the sleeve member 9. The locking member is constituted by a locking collar 20 located between a shoulder 21 of the cap 7 and the one end of the sleeve member 9 facing the shoulder 21. The locking collar 20 is designed in a manner well known in the art and may be of such design that it breaks when the sleeve member is intentionally screwed inwardly, i.e. towards the container 1; thereafter, it can be removed easily.

Figure 1B:
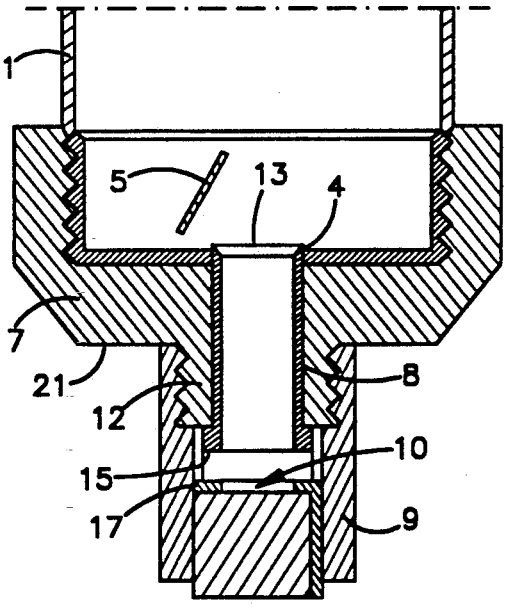
FIG. 1*b* shows a partial longitudinal sectional view of the outlet end of the embodiment according to FIG. 1*a* whereby the device is in its operative position (operating condition)

In order to bring the fluid application device from its inoperative position according to FIG. 1*a* to its operative position according to FIG. 1*b*, first the protection seal 16 is removed; depending on the design, also the locking collar 20 may be removed simultaneously. Then, the sleeve member 9 is screwed inwardly, i.e. towards the container 1, until it abuts against the shoulder 21 of the cap 7. Thereby, the sleeve member 9 is moved towards the container 1 and therewith the cutting member is pressed into the sealing diaphragm 5. The sharp free edge 13 of the cutting member 8 penetrates the sealing diaphragm 5 and breaks it out. The broken-out sealing diaphragm 5 falls into the interior of the container 1, as can be seen in FIG. 1*b*. The broken-out sealing diaphragm 5 is removed from the region of the outlet opening 4 if the device is shortly held upright prior to its use, i.e. with its lid 2 downward.

During the axial movement of the sleeve member 9, the fluid application member 11 is axially immovably fixed by means of the intermediate member 10 with the result that the free front end of the backwardly moved sleeve member 9 exposes the front part of the fluid application member 11 so that it can be used for applying the liquid content of the container 1 onto an article. Furthermore, also the guiding lug 19 emerges from the sleeve member 9 such that it can be used, as desired, as a guiding member during the application of the liquid content of the container 1, as will be further described hereinafter in connection with FIG. 6.

In order to create the possibility to control the amount of liquid content flowing to the fluid application member 11, the container 1 can be designed to be squeezable as shown in FIG. 1*a* by the dash-dot lines 22; this behavior of the container may be realized e.g. by slightly annealing the cylindrical side walls of the container 1 if it is made of a light alloy, e.g. aluminum.

Due to the fact that the device according to FIGS. 1*a* and 1*b* comprises a cap 7 screwed onto the container 1 and serving as an intermediate support member for the fluid application assembly, the embodiment hereinbefore described is particularly well suited for an automated handling. Furthermore, a certain freedom is offered as far as the diameters of the container 1 and the fluid application assembly are concerned, with the result that a container 1 having a relatively large diameter and, thus, a good stability can be used regardless of the need that the fluid application assembly, in certain cases, should be as small as possible. However, as will be explained hereinafter in connection with the description of further embodiments, it is also possible to abstain from the use of a separate cap 7. It is understood that the expenses for the device may be lower if no separate cap 7 is used.

Figure 2A:
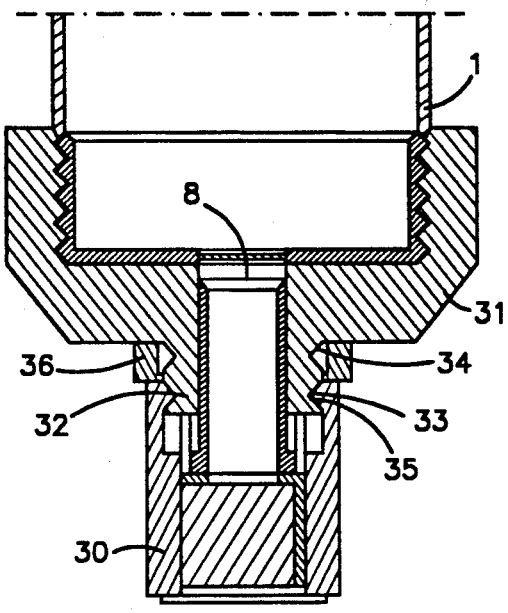
FIG. 2*a* shows a partial longitudinal sectional view of a second embodiment of the device according to the invention whereby the device is in its inoperative position (storage condition)
Figure 2B:
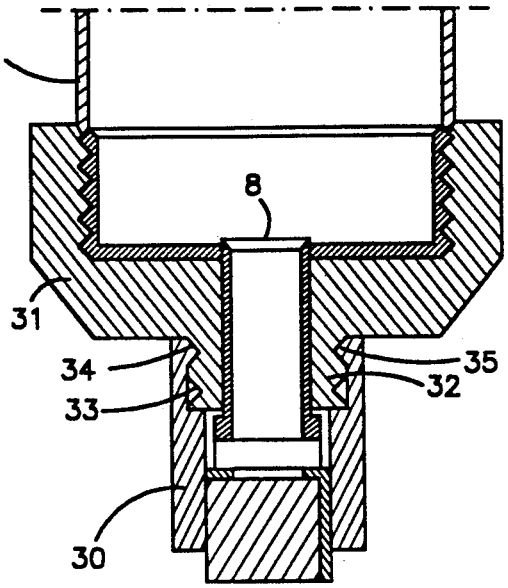
FIG. 2*b* shows a view corresponding to the one shown in FIG. 2*a*, but in its operative position (operating condition)

FIGS. 2*a* and 2*b* show an embodiment of the fluid application device which is somewhat different from the one shown in FIGS. 1*a* and 1*b*. The essential difference consists in the fact that the sleeve member 30 used for the operation of the cutting member 8 is operatively connected to the cap 31 (7 in FIGS. 1*a* and 1*b*) not by means of a screw thread, but is axially displaceably guided along the outer surface of the cylindrical hollow protrusion 32 of the cap 31. In order to open the container 1 by breaking the sealing diaphragm with the help of the cutting member 8, the sleeve member 30 is not rotated as in the embodiment of FIGS. 1*a* and 1*b*, but linearly displaced in axial direction towards the container 1.

The outer cylindrical surface of the cylindrical hollow protrusion 32 is provided with two circumferential grooves 33 and 34 which serve as snap-in places cooperating with a single annular catch member 35; alternatively (not shown), a plurality of segment shaped catch members may be provided. Thereby, the sleeve member 30 is made to be enough elastic that the catch member 35 can be displaced from the one circumferential groove 35 into the other circumferential groove 34 whereby the wall of the sleeve member 30 is elastically deformed.

A locking collar 36 which is designed similar to the locking collar 20 of the embodiment according to FIGS. 1*a* and 1*b* is adapted to keep the sleeve member 30 in the inoperative position (storage condition) as shown in FIG. 2*a*. In order to destroy and remove the locking collar 36, first the sleeve member 30 is rotated whereby no axial displacement of the sleeve member 30 takes place. Then, the locking collar 36 can be removed easily. The remaining parts and elements of the embodiment shown in FIGS. 2*a* and 2*b* are identical to the corresponding parts of the embodiment shown in FIGS. 1*a* and 1*b* and are not further designated nor further described again.

Figure 3A:
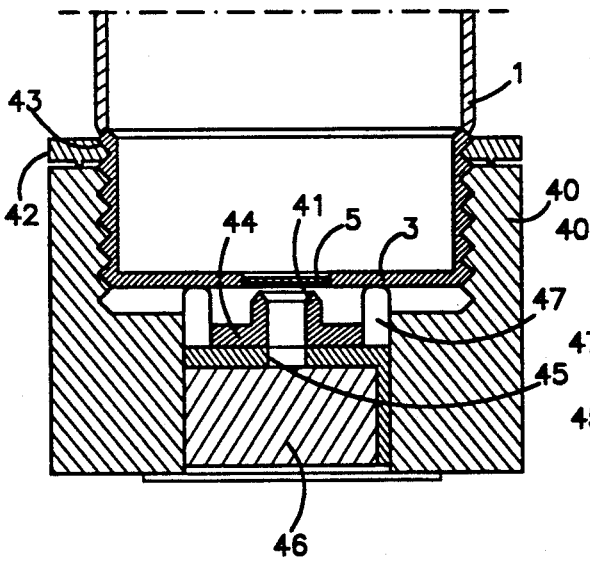
FIGS. 3*a*, 3*b*; 4*a*, 4*b*; 5*a*, 5*b* show partial longitudinal sectional views of three further embodiments of the device according to the invention whereby the devices are in their inoperative position (storage condition) and in their operative position (operating condition), respectively.

The further embodiments according to the invention and shown in FIGS. 3*a*/3*b*, 4*a*/4*b* and 5*a*/5*b* differ from the two embodiments hereinbefore described particularly by the fact that there is no cap (e.g. 7 in FIG. 1*a*) which is screwed onto the container 1 and which serves as an intermediate support member for the fluid application assembly.

Figure 3B:
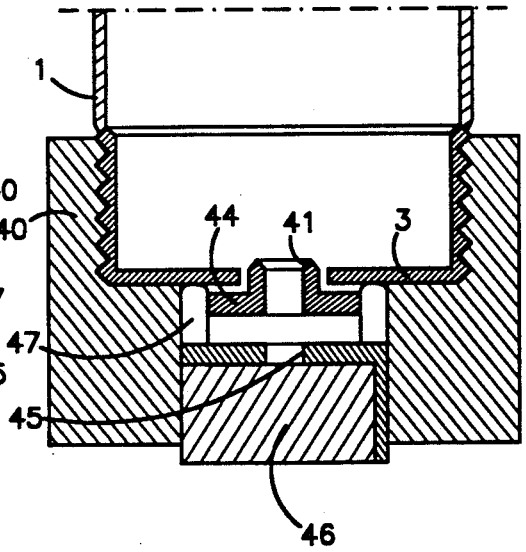

According to FIGS. 3*a* and 3*b*, there is provided a sleeve member 40 screwed directly onto the container 1 which corresponds to the container described in connection with the first and second embodiment. This third embodiment is particularly well suited for a container 1 having a relatively small diameter, e.g. a container having a small internal volume.

In the storage condition of the device as shown in FIG. 3*a*, the sleeve member 40 serving for the operation of the cutting member 41 is locked in its inoperative position by means of a locking collar 42 which rests on a shoulder 43 of the container 1 constituted by the last flight of the screw thread. The cutting member 41 connected to the sleeve member 40 by means of a flange 44 is somewhat different in this embodiment and relatively short since there is no cap (7 in FIGS. 1*a* and 1*b*) and, consequently, also no cylindrical hollow protrusion (12 in FIGS. 1*a* and 1*b*). Thus, the cutting member 41 can be made shorter by an amount corresponding to the axial length of the two aforementioned elements.

The intermediate member 45 on which the fluid application member 46 rests is generally of similar design as shown in FIG. 1*a* and 1*b*, with the difference that the support members 47 rest immediately against the front container wall 3. For the rest, the mode of operation of and the effect produced by the sleeve member 40 and the cutting member 41 are essentially the same as described in connection with the embodiment according to FIGS. 1*a* and 1*b*.

Figure 4A:
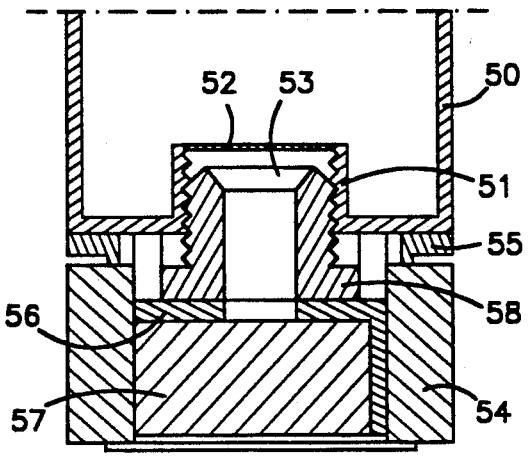

The further embodiments according to FIGS. 4*a*/4*b* and 5*a*/5*b* differ from the embodiment shown in FIGS. 3*a*/3*b* by the fact that the container 50 does not comprise an outer male screw thread for the operative connection of the fluid application assembly, but a threaded extension surrounding the outlet opening of the container. Thus, the shape of the container can be selected more freely, i.e. it must not be cylindrical as is necessary when its outer wall is to be provided with a screw thread. Particularly, the container may have a square or other polygonal cross section.

Figure 4B:
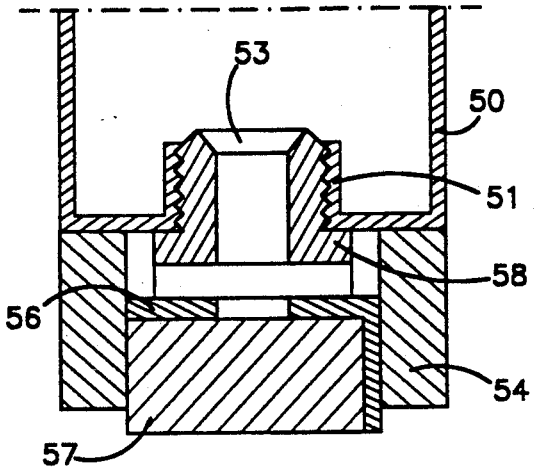

In FIGS. 4*a* and 4*b*, a first example of such an embodiment of the fluid application device according to the invention is shown. The container 50 is provided, on its outlet end, with an inwardly directed threaded extension 51 having an internal thread. The sealing diaphragm 52 is located at the inner end of the threaded extension 51. The cutting member 53 which performs an axial movement required for breaking out the sealing diaphragm 52 is, in this embodiment, directly screwed into the threaded extension 51. The sleeve member 54 used for the operation of the cutting member 53 does not have a direct connection to the container 50. Similarly to the previously described embodiments, the sleeve member 54 is connected to the cutting member 53 by means of a flange 58. A locking collar 55 is provided which locks the sleeve member 54 against unintentional axial movement as long as the fluid application device is in its inoperative position (storage condition). The locking collar 55 is inserted between the one end face of the sleeve member 54 which faces the container 50 and the front wall of the container 50. The intermediate member 56 supporting the fluid application member 57 is designed as described in connection with the previous embodiments.

Figure 5A:
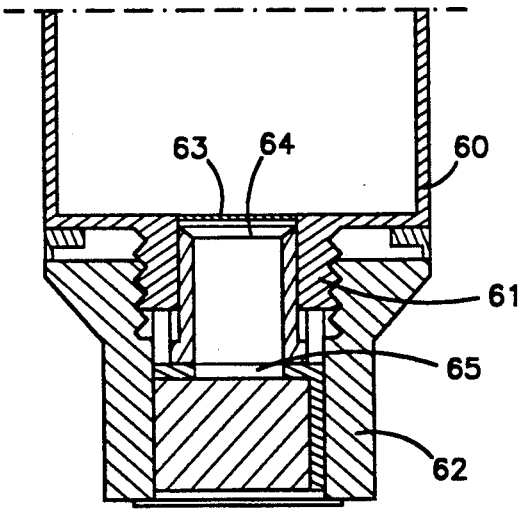
Figure 5B:
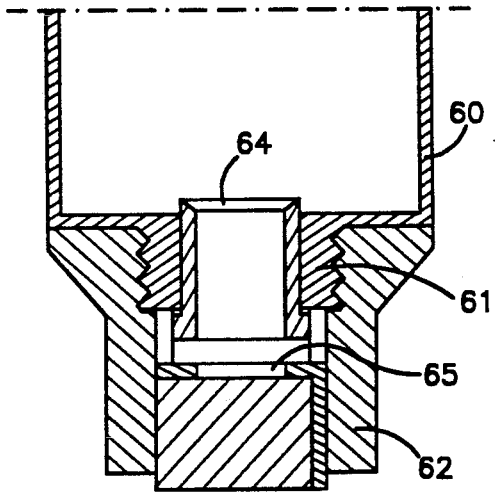

In the embodiment according to FIGS. 5*a* and 5*b*, the container 60 is provided a threaded extension 61 extending away from the front wall of the container 60. The sleeve member 62 is screwed onto the threaded extension 61. The arrangement of the sleeve member 62 and the design of the remaining elements, e.g. the sealing diaphragm 63, the cutting member 64 and the intermediate member 65, is similar to the one shown in and described in connection with FIGS. 1*a* and 1*b*. The embodiment according to FIGS. 5*a* and 5*b* results in a very compact fluid application device in which the application assembly can be designed quite narrow.

Figure 6:
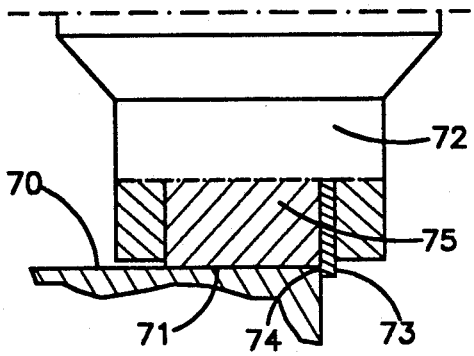
FIG. 6 shows an example of a mode of operation of the device according to the invention.

In FIG. 6, the fluid application device according to the invention is shown in a frequently occurring operation example. Supposing that a layer 71 of a liquid primer should be applied along the edge of a flat article surface 70. The longitudinal track of the layer 71 extends perpendicular to the drawing plane. With this aim in view, the locking collar is destroyed and removed, respectively, and the sleeve member is axially moved towards the container to expose the fluid application member 75; thus, the device is ready to use. Now, the device 72 is put on the surface 70 such that the guiding lug 73 is positioned directly next to the terminal edge 74 of the article surface 70. During the subsequent pressing of the device 72 against the article surface 70, the fluid application member 75 is somewhat compressed such that the guiding lug 73 engages the terminal edge 74 of the article; thus, the device is precisely guided along the edge 74 of the article when the fluid application device is moved along the edge 74 of the article. The result is that the applied primer layer 71 has an exactly defined track extension. For the rest, the guiding lug 73 can generally be designed such that it can be partly or completely broken away if it is not to be used.

What we claim is:

1. A device for applying a fluid medium onto the surface of an article, particularly for applying a moisture-sensitive primer for adhesive joints, comprising:

a moisture- and air-tight container for receiving said fluid medium, said container having a central longitudinal axis and being provided with an application means;

said container comprising an outlet opening and a sealing diaphragm sealing said outlet opening of said container in an air- and moisture-tight manner;

said application means being fixed to said container at said outlet opening of said container and comprising a fluid application member which is immovable with regard to said container and which is laterally covered by a sleeve member;

said sleeve member being displaceable in the direction of said central longitudinal axis of said container whereby a locking member is provided to prevent an unintentional axial displacement of said sleeve member;

said sleeve member further comprising a cutting member displaceable together with said sleeve member and adapted to destroy said sealing diaphragm;

said fluid application member being exposed out of the interior of said sleeve member and said sealing diaphragm being destroyed upon removing or destroying said locking member and displacing said sleeve member along said central longitudinal axis towards said container.

2. A device according to claim 1 in which said application means comprises a cap screwed onto said container at the end thereof where said outlet opening is provided, said cap comprising a cylindrical hollow protrusion, said sleeve member being axially displaceably mounted on said protrusion, whereby further a locking collar is provided on said protrusion serving as said locking member and being located between said sleeve member and said cap.

3. A device according to claim 2 in which said cutting member is fixed to said sleeve member by means of a flange member and in which said cutting member is constituted by a hollow cylindrical member having a sharp free edge at the side facing said container, being arranged coaxially to said sleeve member and displaceable along the extension of said protrusion provided on said cap.

4. A device according to claim 3 in which said cutting member, said sleeve member and said flange member are preferably made of a plastic material in one piece.

5. A device according to claim 2 in which said fluid application member is supported in said sleeve member by means of an annular washer comprising a lateral lug, said annular washer comprising a plurality of support members extending away from said fluid application member and resting with their free ends at the front wall of said cylindrical hollow protrusion of said cap.

6. A device according to claim 5 in which said lug extends along one side of said fluid application member up to the operating end thereof and serves as a guiding member during the operation of the device.

7. A device according to claim 1 in which said locking member is constituted by an annular collar serving as a releasable stop member, said annular collar being located such between the one end of said sleeve member facing a cap and a shoulder face of said cap that it is destroyed upon screwing said sleeve member towards said cap.

8. A device according to claim 2 in which said sleeve member is axially displaceably guided along the outer surface of said cylindrical hollow protrusion in order to operate said cutting member.

9. A device according to claim 8 in which said outer surface of said cylindrical hollow protrusion is provided with circumferential grooves constituting snap-in places cooperating with an annular catch member or with a plurality of segment-shaped catch members provided on said sleeve member whereby the catch member or the plurality of catch members can be displaced from one of said grooves to another one of said grooves under elastic deformation of the wall of said sleeve member.

10. A device according to claim 1 in which said sleeve member is screwed directly onto said container and blocked, in its inoperative position, by means of a locking collar, said locking collar resting on a shoulder of said container constituted by a screw thread flight.

11. A device according to claim 1 in which said container comprises on its front wall a threaded extension onto which said sleeve member is screwed.

* * * * *